US005404824A

United States Patent [19]

Hiraoka et al.

[11] Patent Number: 5,404,824

[45] Date of Patent: Apr. 11, 1995

[54] NEEDLE THREAD FEED CONTROL APPARATUS FOR SEWING MACHINE

[75] Inventors: Akimitsu Hiraoka; Ito Fumio, both of Chofu, Japan

[73] Assignee: JUKI Corporation, Tokyo, Japan

[21] Appl. No.: 144,822

[22] Filed: Oct. 28, 1993

[51] Int. Cl.[6] ..... D05B 45/00; D05B 65/00

[52] U.S. Cl. ..... 112/254; 112/297; 112/300

[58] Field of Search ..... 112/273, 278, 302, 254, 112/255, 242, 297, 301, 300

[56] References Cited

U.S. PATENT DOCUMENTS

| | | | |
|---|---|---|---|
| 3,408,832 | 11/1968 | Renpei et al. | 112/254 X |
| 3,628,480 | 7/1970 | Van Ness | 112/255 X |
| 4,215,641 | 8/1990 | Dobrjanskyj et al. | 112/255 X |
| 4,949,657 | 8/1990 | Hanyu et al. | 112/254 X |

FOREIGN PATENT DOCUMENTS

| | | | |
|---|---|---|---|
| 0813929 | 7/1951 | Germany | 112/254 |
| 58-112581 | 7/1983 | Japan . | |
| 2224395 | 10/1987 | Japan | 112/254 |
| 3-191986 | 8/1991 | Japan | 112/254 |
| 0386219 | 4/1965 | Switzerland | 112/254 |
| 1652407 | 5/1991 | U.S.S.R. | 112/254 |

*Primary Examiner*—Clifford D. Crowder
*Assistant Examiner*—Ismael Izaguirre
*Attorney, Agent, or Firm*—Morgan & Finnegan

[57] ABSTRACT

A thread control apparatus having first and second thread retainer or holder mechanisms on a thread path, a feed passage control mechanism adapted to obtain the thread in a zig zag form between the first and second thread holder mechanisms, and a controller actuated to allow these holder mechanisms to be in a thread hold condition and a thread release condition, respectively, just before starting thread cutting or trimming operation. Slack is provided in the thread by deactuating the feed passage control mechanism after the thread has been delivered from the thread supply source by operation of the feed passage control mechanism. The thread is released by the first thread retainer mechanism and held by the second thread retainer mechanism until the next sewing operation is started upon trimming or cutting the thread to render the thread path longer by means of the feed passage control mechanism, thereby drawing back the residual thread.

5 Claims, 12 Drawing Sheets

NEEDLE THREAD FEED CONTROL APPARATUS FOR SEWING MACHINE

BACKGROUND OF THE INVENTION

This invention relates to needle thread feed control apparatus for sewing machines for forcibly performing a needle thread feed operation independently of stitch forming operation. More particularly, this invention relates to a needle thread regulating mechanism for rendering thread cutting or trimming and obtaining a suitable stitch start end.

Various types of prior art sewing machines have been provided with thread cutter or thread trimmer mechanisms which include a thread catch knife mounted downwardly of the needle plate to seize and draw the sewing threads, such as needle and bobbin threads, and a thread trimmer knife, for cutting the threads therebetween.

Such thread cutter mechanisms have been required to properly set an amount of the needle thread to be drawn by the thread trimmer knife, that is, a stroke at which the thread catch knife is moved for starting a next sewing operation in a proper manner. For instance, a lesser amount of needle thread drawn by the thread catch knife results in an insufficient amount of needle thread which is led from the cutting end to an eyelet in the needle through which the needle thread (hereinafter referred to as "residual thread") passes. This will move the cutting end of the needle thread out of the thread at one stitch immediately in the next sewing operation failing to perform sewing operation. Further, a longer residual thread than is necessary either projects from the underside of the work fabric or is entrained in a "bird's nestle" so that the quality of the work fabric is deteriorated.

A thread cutter or trimmer mechanism of this type, which is designed to precisely set the stroke of the thread catch knife has presented difficulty in obtaining a constant length of the thread when it is used under such a condition that the type and thickness of the fabric, the type and denier of the thread, and the speed at which the thread cutter mechanism is moved are changed or varied.

A feed control apparatus as disclosed in Japanese Patent Publication No. Sho 60-48196 and shown in the accompanying drawings, FIGS. 10, 11, and 12, has been proposed to avoid such difficulty to obtain the thread as left with stability, that is, constant in its length.

As illustrated, a lockstitch sewing machine 1 includes an arm 2 which is provided with a needle bar 3 for holding a needle, a thread takeup lever, and a main thread tension unit 5 for applying a predetermined tension to a needle thread as are well known in the art.

The feed control apparatus in the above-mentioned lockstitch sewing machine comprises mainly a feed passage control mechanism A for regulating the passage through which the needle thread passes and for feeding the same, a needle thread pull back mechanism B, and a releasing mechanism C for releasing the needle thread clamped by the main thread tension unit 5 from its pressure. These mechanisms are adapted to cooperate with each other.

More specifically, the feed passage control mechanism A has a solenoid 6 mounted on the front wall of arm 2, a delivery lever 7 rotatable about a screw 8 formed on arm 2 and against the bias of a spring 9, and a first auxiliary thread tension unit 10 mounted on one end of delivery lever 7. The first auxiliary thread tension unit 10 is adapted to clamp the needle thread fed from a needle supply source (not shown) by thread tension discs 10*a*, 10*b* back from the main thread tension unit 5. The needle thread pull back mechanism B comprises a second solenoid 11 positioned on the front wall of the arm 2, a lock lever 12 connected to a plunger 11*a* of the solenoid 11. The lock lever 12 is adapted to rotate about a screw 13 against the bias of a spring 14 when plunger 11*a* of the solenoid 11 is advanced.

The releasing mechanism C comprises a first release lever 15 which is rotatably mounted by a screw 16 to the front wall of arm 2 and counterclockwise energized by a spring 19, a connecting link 17 which cooperates with delivery lever 7 to rotate release lever 15, and a connecting lever 18.

Numerals 21, 22, and 23 designate a second auxiliary thread tension unit, a sub-thread tension unit, and a second release lever for releasing the second auxiliary thread tension unit 21. Release lever 23 is adapted for movement in association with the connecting link 17. Numeral 14 denotes a check spring mounted to the thread tension unit 5.

Each of the mechanisms and elements or parts of the feed control apparatus is located in an initial position as shown in FIG. 10 during sewing operation, where the thread tension unit 5 is allowed to clamp a needle thread I1 under a predetermined pressure by a pair of the thread tension discs 5*a*, 5*b*, and a release plate 10*c* is interposed between the thread tension discs 10*a*, 10*b* of the first auxiliary thread tension unit 10 while a release lever 23 is inserted between thread tension discs 21*a*, 21*b* of the second auxiliary thread tension unit 21. With this arrangement, both of the auxiliary thread tension units 10, 21 assume a state in which the needle thread is released whereas the auxiliary thread tension unit 22 is in a condition to normally hold the thread needle.

A thread cutting signal is output after the sewing operation to operate the solenoid 6 just before the thread cutting is initiated by the thread cutting mechanism (not shown), rotating counterclockwise the delivery lever 7 to hold the apparatus in the condition as shown in FIG. 11. In this connection, it may be noted that the first auxiliary thread tension unit 10, movable with the delivery lever 7, is kept away from the release plate 10*c* to clamp the needle thread I1 to then draw the same out of the side of the thread supply source. As a result, the needle thread I1 located in the range from the first auxiliary tension unit 10 to the needle is slackened to an extent corresponding to the amount of thread as drawn. At this moment the needle thread as drawn by the first auxiliary tension unit 10 amounts to $L+\alpha$, wherein L is the length of needle thread required for next sewing operation, and $\alpha$ is some play.

Under the condition in which the needle thread is let out, the threat cutting operation is performed. For this reason, the thread cutting mechanism is adapted not only to smoothly feed the needle thread with the thread catch knife but also to readily cut the needle thread by the thread cutter knife. In this connection, it is noted that the delivery lever 7 urges back the lock lever 12 against the bias of spring 14 due to its counterclockwise rotation and then engages tongue 12*a* of the lock lever 12 so that the lever 7 may be maintained in a position where it is rotated even if the solenoid is deactuated.

Now, the next sewing operation is initiated, solenoid 11 is actuated between the first stitch and a couple of stitches to clockwise rotate the lock lever 12, thus releasing one end of the delivery lever 7. This will clockwise rotate the delivery lever 7 to a position where it is located (FIG. 12) between the initial position as shown in FIG. 10 and the delivery position as shown in FIG. 11 by engagement of the stopper 12*a* on lock lever 12 with the end of the connecting lever 18.

In this manner, the delivery lever 7 is moved to a position between the initial position and the delivery position so that the needle thread is stretched in a position where the needle is positioned is pulled back by the first auxiliary thread tension unit 10 to the needle thread supply source. The needle thread length to be pulled back would be the length about one-half of the play. The half of the thread, as residual of the play $\alpha$, is pulled up by up-movement of the thread takeup lever. This will leave a thread amount one-half of the length L at the beginning of sewing operation performed in the work fabric. The conventional apparatus has been effective in preventing the needle thread I1 from falling out of the needle at the beginning of the sewing operation and avoiding not only formation of the bird's nestle at the beginning of the sewing operation on the work fabric but also excess length of residual thread.

Notwithstanding, the conventional apparatus is arranged so that the needle end thread left by thread cutting operation is pulled back during several stitches after the next sewing operation to make an accurate pull-back operation impossible. More specifically, the pull-back operation, if performed after the sewing operation, is immediately followed by the needle thread draw-out operation performed by the needle, hook and the like one after the other. Subsequently, the needle thread is subjected to considerable elongation and frictional resistance to readily vary the amount of thread pulled back. The needle thread is required to perform the pull-back operation synchronously with driving the sewing machine complicating regulation and control. The overall works are rather intricate because the prior art apparatus is such that the needle thread is fed and pulled back by moving the first auxiliary tension unit 10. This necessitates adjustment of the clamping force by taking into account the type of the needle thread I1 to be applied and the force exerted by the main thread tension unit 5 to the thread. More specifically, for positive needle thread delivery and pull-back operation, a clamping force as high as possible is set so as not to allow alignment of the needle thread out of a position where it is clamped by the first auxiliary thread tension unit 10. However, if the needle thread clamping force is greater than the force exerted on the needle thread by the main thread tension unit, tension on the upper thread is considerably high at the time when sewing operation is initiated failing to obtain proper tightness of stitches and stitch perforation.

In view of the foregoing, the force applied to the upper thread I1 by the first auxiliary thread tension unit 10 should be set in such a manner that it is lower than the force applied to the upper thread I1 by the main thread tension unit 5 on one hand, and the needle thread I1 is not out of alignment within the first auxiliary thread tension unit on the other hand. This will require that the apparatus involve much difficulty and great complexity in adjustment and setting of the value of the force. If a change in the type of the needle thread is required, a low productivity is involved in the conventional apparatus if it is in use.

SUMMARY OF THE INVENTION

It is, therefore, an object of the present invention to provide a needle thread feed control apparatus which obviates the disadvantages of the conventional needle thread feed control apparatus.

Another object of the invention is to provide a needle thread feed control apparatus which is capable of preventing thread cast-off at the beginning of a sewing operation without requiring any complicated adjustment.

A further object of the invention is to provide a needle thread feed control apparatus which is capable of preventing not only the remaining thread from extending too long but also the so-called "bird's nest" from being formed in a first stitch of a seam thereby obtaining the work fabric of high quality.

A further object of the invention to provide a thread control apparatus which is capable of positively and accurately delivering and drawing back the thread, and more particularly, the upper thread with no complicated operation as required by the prior art irrespective of the dimensions or the material of the threads to be used.

A further object of the invention is to provide a needle thread control apparatus for performing a stable thread cutting or trimming to obtain the residual or remaining thread in an optium length to fully eliminate the so-called "bird's nest" therein, and thereby assuring uniform quality of the product.

These and other objects are met by providing in a sewing machine which includes thread cutting means for cutting a thread downwardly of a needle plate in response to generation of a thread cutting signal, a first holder means disposed in a thread path leading from a predetermined thread supply source to a needle to hold or release the thread and a second holder means arranged in the thread path on the side of the needle away from the first holder means to hold or release the thread, a thread control apparatus including thread drawing means located between the first and second holder means and capable of presenting a first operative condition in which the thread on said thread supply source side is drawn out in a predetermined amount by the first holder means and a second operative condition in which the thread on the thread supply source side is drawn out in a predetermined amount by the second holder means.

Additionally, control means are provided which is adapted to establish control in such a manner that not only the second holder holds the thread whereas the first holder releases the thread prior to start of thread cutting operation by the thread cutting means but also the thread drawing means presents the first operative condition, and that not only the second holder releases the thread whereas the first holder holds the thread during the period of time when thread cutting operation is finished and the next sewing operation is started but also the thread drawing means presents the second operative condition.

BRIEF DESCRIPTION OF THE DRAWINGS

The invention is described in greater details below by way of reference to the accompanying drawings in which.

DETAILED DESCRIPTION OF THE DRAWINGS

Figure 1:
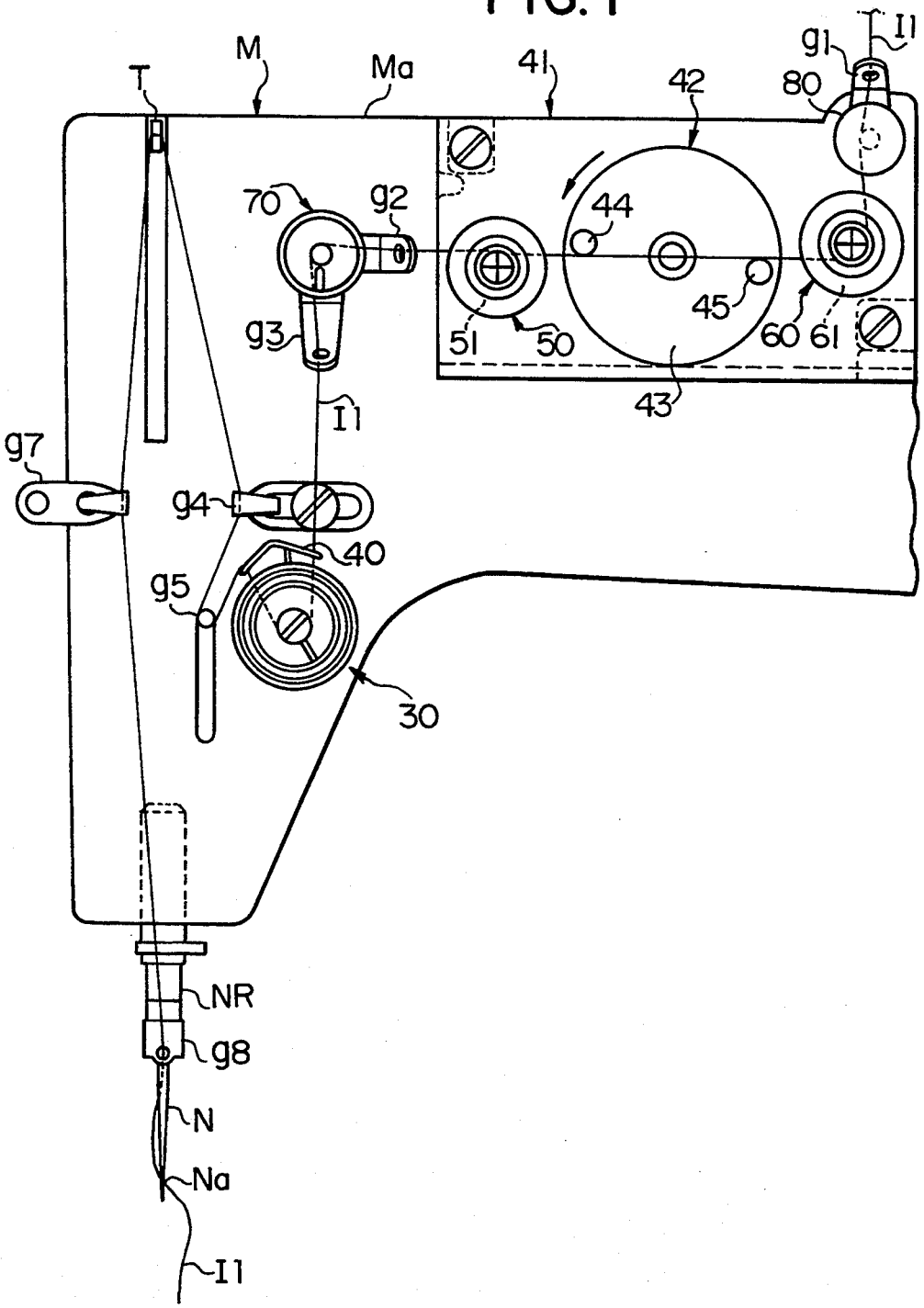
FIG. 1 is a partial front view of a needle thread feed control apparatus embodying the present invention.
Figure 2:
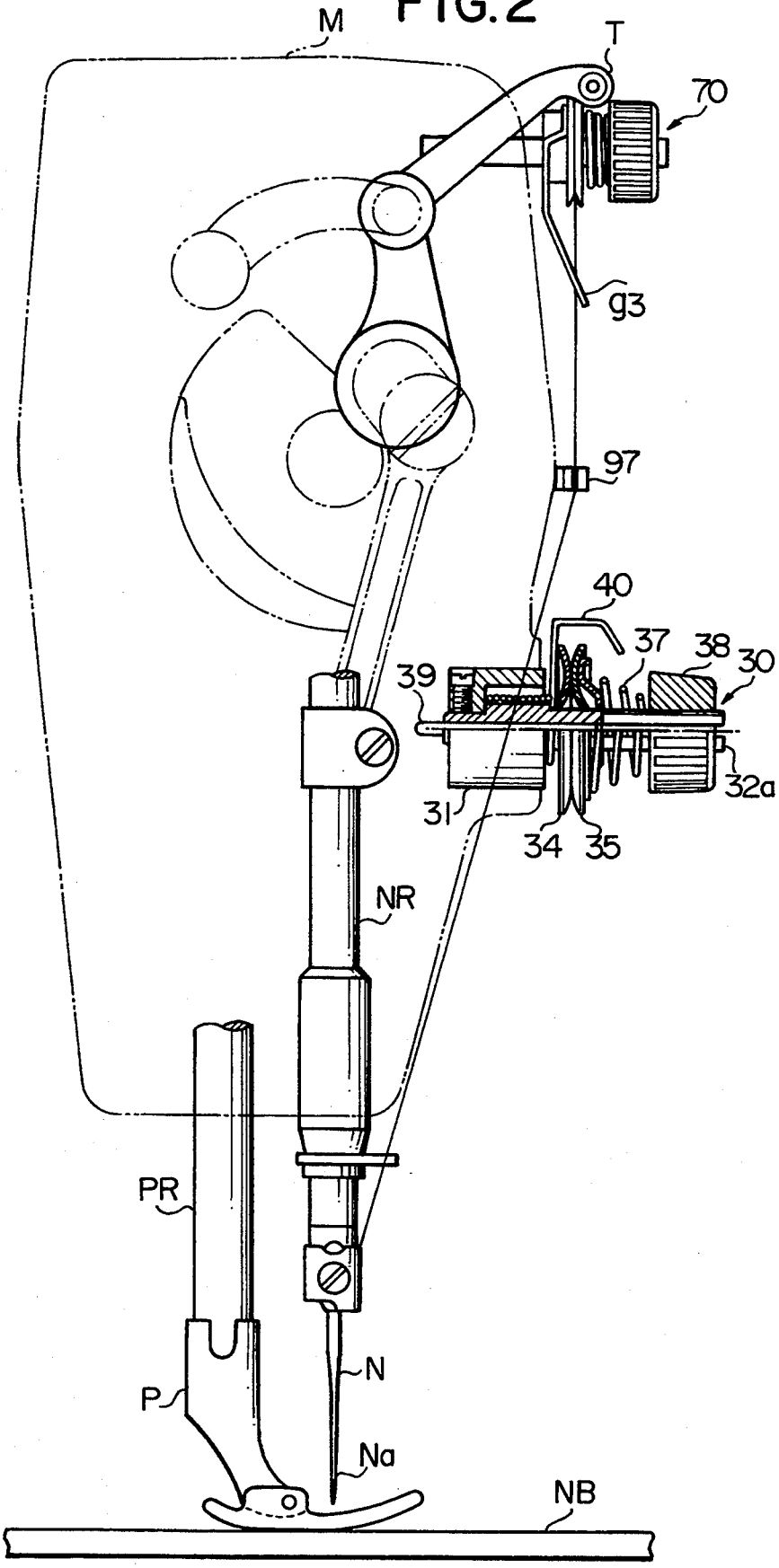
FIG. 2 is a partial side view of the needle thread feed control apparatus shown in FIG. 1.

Referring to FIGS. 1 through 9, a preferred embodiment of the present invention will be explained. With particular reference to FIGS. 1 and 2, there is shown a lockstitch sewing machine M embodying the invention and an arm Ma of the sewing machine. A needle bar NR is supported on the machine arm Ma for vertical movement. The needle bar NR carries a sewing needle N attached thereto. The machine arm Ma holds a presser bar PR for vertical movement. A work clamp member P is mounted to the lower end of the presser bar PR. A well known thread takeup lever T is formed on the sewing machine.

Figure 3A:
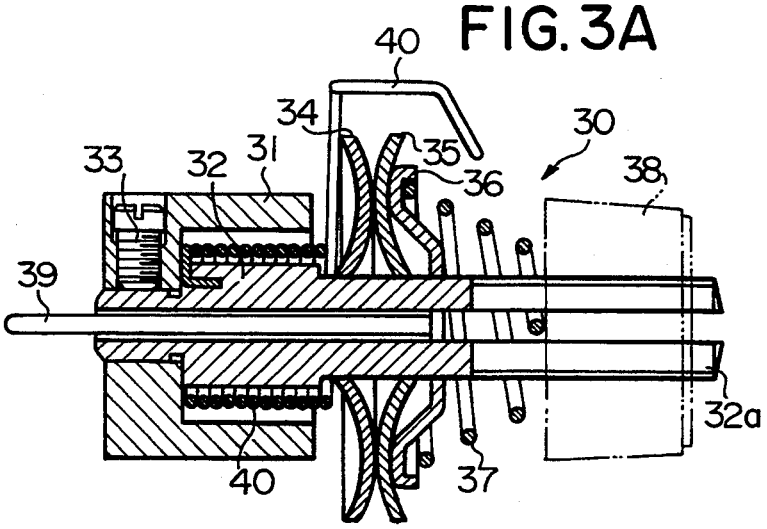
FIG. 3A is a side sectional view of a main thread tension unit of the invention showing the manner in which the upper thread is clamped.
Figure 3B:
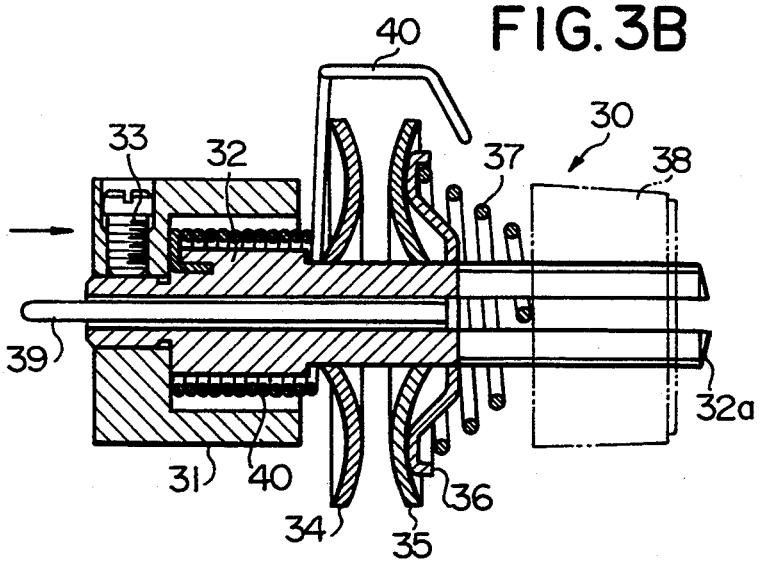
FIG. 3B is a side sectional view similar to FIG. 3A but showing the manner in which the needle thread is released.
Figure 4:
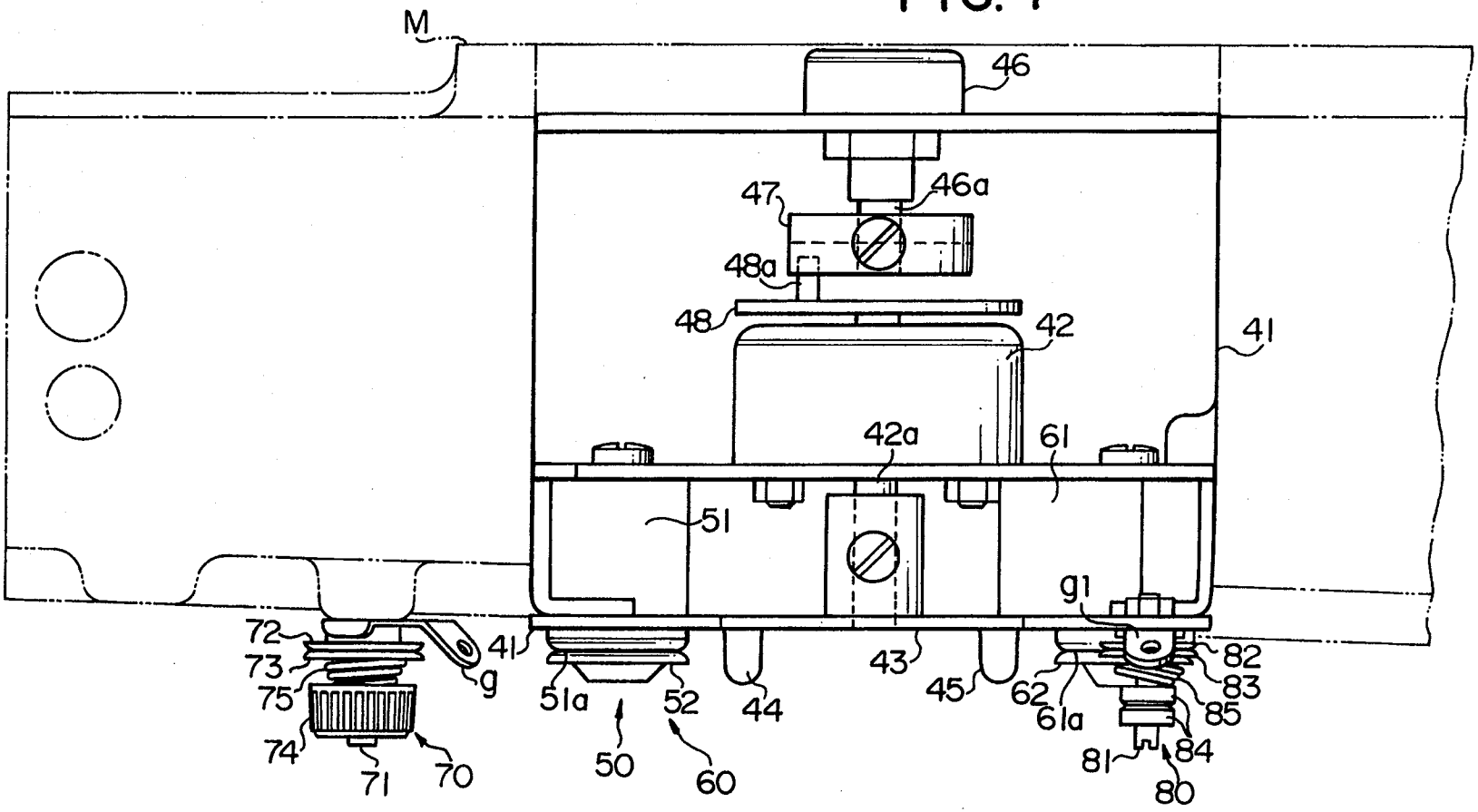
FIG. 4 is a partial plan view of the needle thread feed control apparatus shown in FIG. 1.

A main thread tension unit 30 is mounted in the front of the machine arm and configured as shown in FIGS. 3A and 3B, wherein a thread tension base 31 in a cylindrical form is secured to the front wall of the sewing machine arm Ma and is provided with a thread tension bar 32 fixed to the base 31 by a set screw. The thread tension bar 32 incorporates therein a check spring 40, a pair of thread tension discs 34, 35, a disc presser 36, and a thread tension spring 37. A thread tension nut 38 is threaded into a threaded portion 32*a* formed at the forward end of the thread tension bar 32. With this arrangement, compressive force of the thread tension spring 37 may adjusted by rotating the thread tension nut 38 so that thread clamping force applied to the thread tension discs 34, 35 may be regulated by means of the disc presser 36.

A disc floating pin 39 is movably inserted into the center of the thread tension bar 32 and includes one end abutted against the other thread tension disc 35 and the other end projected into the machine arm Ma. A thread trimmer solenoid (not shown) is so provided at the other end of the disc floating pin 39 as to cooperate with the solenoid and is actuated by a thread trimmer signal to forwardly urge the disc floating pin 39 toward the side of the thread tension nut 38. Thus, the disc pressure 36 is directed away from the thread tension disc 35 against the bias of the thread tension spring 37, releasing both thread tension discs 34, 35 from the clamping pressure applied to the upper needle.

Referring back to FIG. 1, mount base 41 is mounted to the arm of the sewing machine in front and at the top thereof and carries thereon a rotary solenoid 42 (FIG. 4) whose armature 42*a* is equipped at one end thereof with a rotary plate 43 in a disc form flush with the front of the mount base. The rotary disc 43 is rotated in unison with the armature 42*a* and formed with a pair of thread delivery pins 44, 45 symmetrical about the center of rotation thereof.

The mount base is provided with a potentiometer 46 mounted rearwardly thereof, whose rotary shaft 46*a* is connected to the armature 42 of the rotary solenoid 42 by a sensor arm 47, a connecting pin 48*a*, and a disc 48. The potentiometer 46 is adapted to detect how many times the armature 42 is rotated.

First and second upper thread retainer means 50, 60 are mounted on the front of the mount base 41 and disposed symmetrically about the disc 43. Since these upper thread retainer means 50, 60 are identical in structure, it is deemed sufficient to describe the first upper thread retainer means 50. This upper thread retainer means is arranged so that the solenoid 51 carries a plunger (not shown), to which a fitting plate 52 is secured, which is energized to rearwardly attract the plunger and thereby clamping the upper thread between the fitting plate 52 and a front face 51*a* of the solenoid. On the other hand, the solenoid 42 is deenergized to forwardly project the fitting plate 52, as well as the plunger, for releasing the upper thread. Similarly, the second upper needle retainer means 60 is arranged securing fitting plate 62 to the plunger of the solenoid.

These upper thread retainer means each have stronger needle thread clamping force and are adapted to prevent the upper thread I1 from deviating from position to retain the thread by the thread draw-out operation performed by, for instance, the thread takeup lever and the thread trimmer described below, even if the most slippery needle thread is used.

A sub thread tension unit 70 is mounted on the front wall of the arm M and second sub thread tension unit 80 is provided on the mount base. The first sub thread tension unit 70 is located between a solenoid 61 and the thread takeup lever T and arranged so that a pair of thread tension discs 72, 73 removably inserted in a thread tension bar 71 fixed to the front wall of the arm M, and that a thread tension nut 74 is threaded into the forward end of the thread tension bar 71 to press a thread tension spring 75 between the thread tension disc 73 and the thread tension nut 74. Rotation of the thread tension nut 74 will change a condition in which the thread tension spring 75 is compressed. Subsequently, the upper thread clamping force may be adjusted. In this connection it is noted that the first sub thread tension unit is adapted to generate upper tensile force up to 0—several g.

The second sub thread tension unit 80 is positioned between the upper thread supply source (not shown) and the second upper thread retainer means 60, as is similar to the first sub thread tension unit 70, comprises a thread tension bar 81, a pair of thread tension discs 82, 83, a thread tension nut 84, and a thread tension spring 85 and is adapted to clamp the upper needle with a clamping force so as to apply tension up to several g. to the upper thread.

Figure 5A:
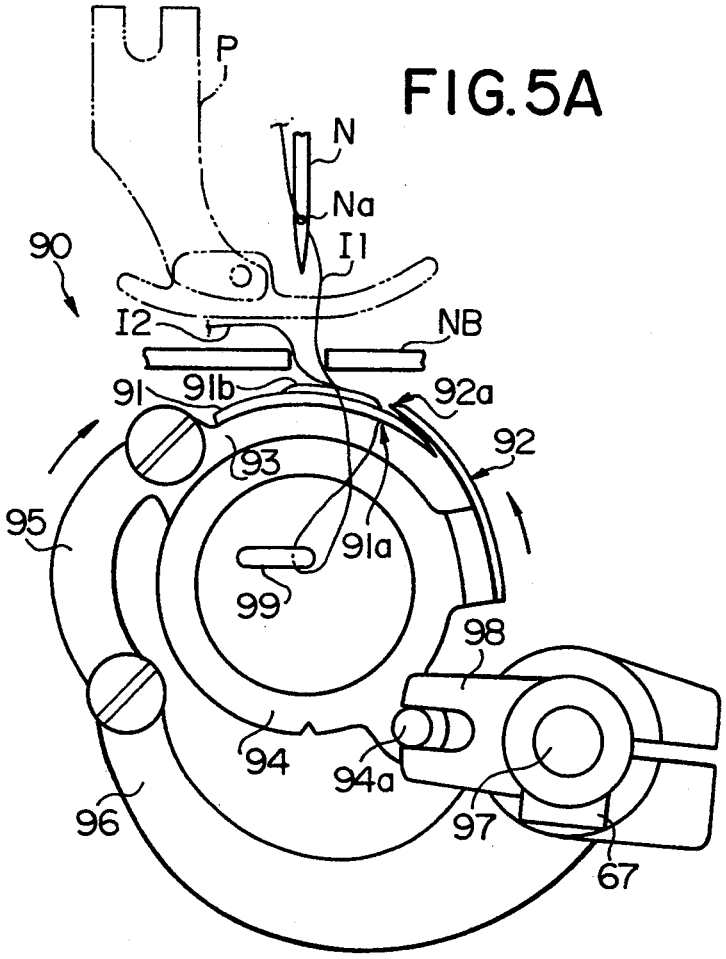
FIG. 5A is a front view of a thread cutting mechanism of the invention.
Figure 5B:
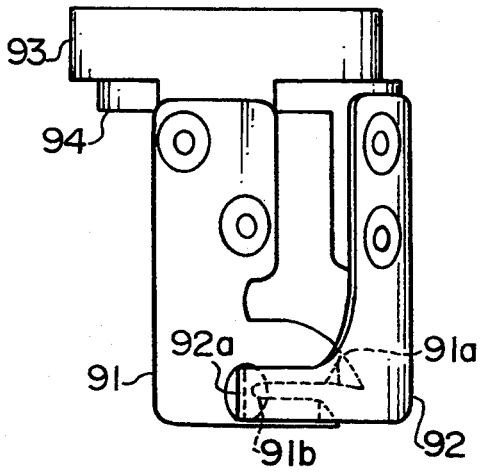
FIG. 5B is a plan view of the thread cutting mechanism.

As seen in FIG. 5, a thread trimmer mechanism 90 is mounted within a bed (not shown) of the lockstitch sewing machine. A thread spreading blade 91 is provided at its one end and center with a thread seizing portion and a knife edge 91*b*. A thread trimmer blade 92 is formed at its one end with a knife edge 92*a*. These blades 91, 92 are rigidly mounted on supports 93, 94 which are rotatable concentrically with the hook incorporated in the sewing machine. The support 93 is coupled by links 95, 96 to a drive shaft 97, and the other support 94 is in turn connected by a connecting pin 94*a* and a rotary arm 98 to the drive shaft 97.

A signal which serves to initiate thread trimming is output to actuate a solenoid (not shown) for providing the drive shaft with reciprocal rotational movement at a predetermined angle. This will reciprocally move the supports 93, 94 in opposite directions so that the blades 91, 92 are reciprocated to trim the threads, namely, the upper and lower threads.

In the initial condition in which the signal is not output yet, the blades 91, 92 are held in a position where they are laterally retracted from a path for vertical movement of the needle N. Then the signal is output to clockwise rotate the rotary plate 43 from the initial position to seize the upper needle thread I1 caught by the hook and the bobbin thread, thereby laterally and sideways drawing out the upper needle thread I1 as well as a picker 99. The blade 92 is then counterclockwise rotated to allow the knife edge 92*a* and the thread spreading blade 91 to trim the threads seized adjacent the path for vertical movement of the needle.

It is understood that after cutting or trimming the upper thread, both blades 91, 92 are returned to their initial position by back movement of the drive shaft 97 to provide for the next sewing operation.

Figure 6:
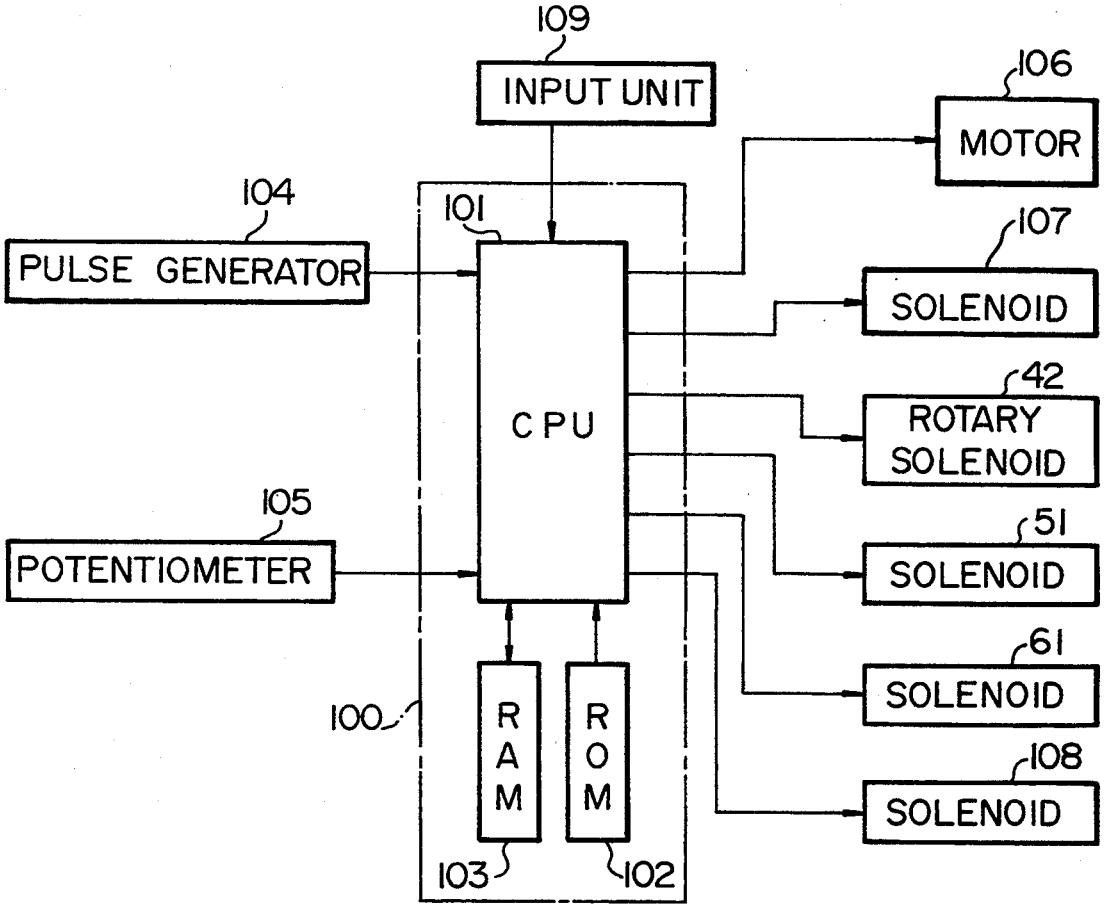
FIG. 6 is a block diagram of arrangement of a control circuit of the invention.
Figure 7:
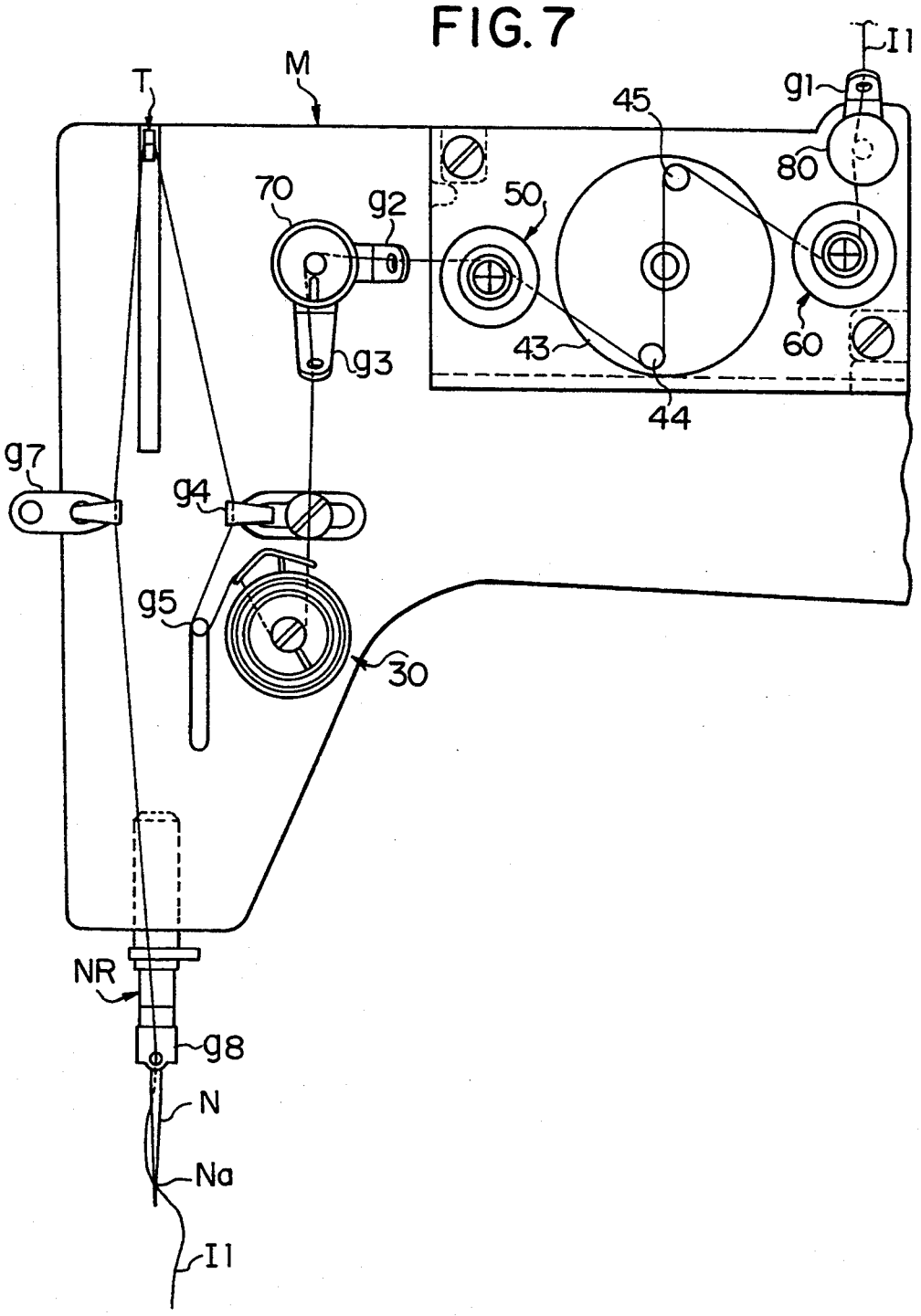
FIG. 7 is a partial front view of the needle thread feed control apparatus showing the upper thread fed from what is shown in FIG. 1.
Figure 8:
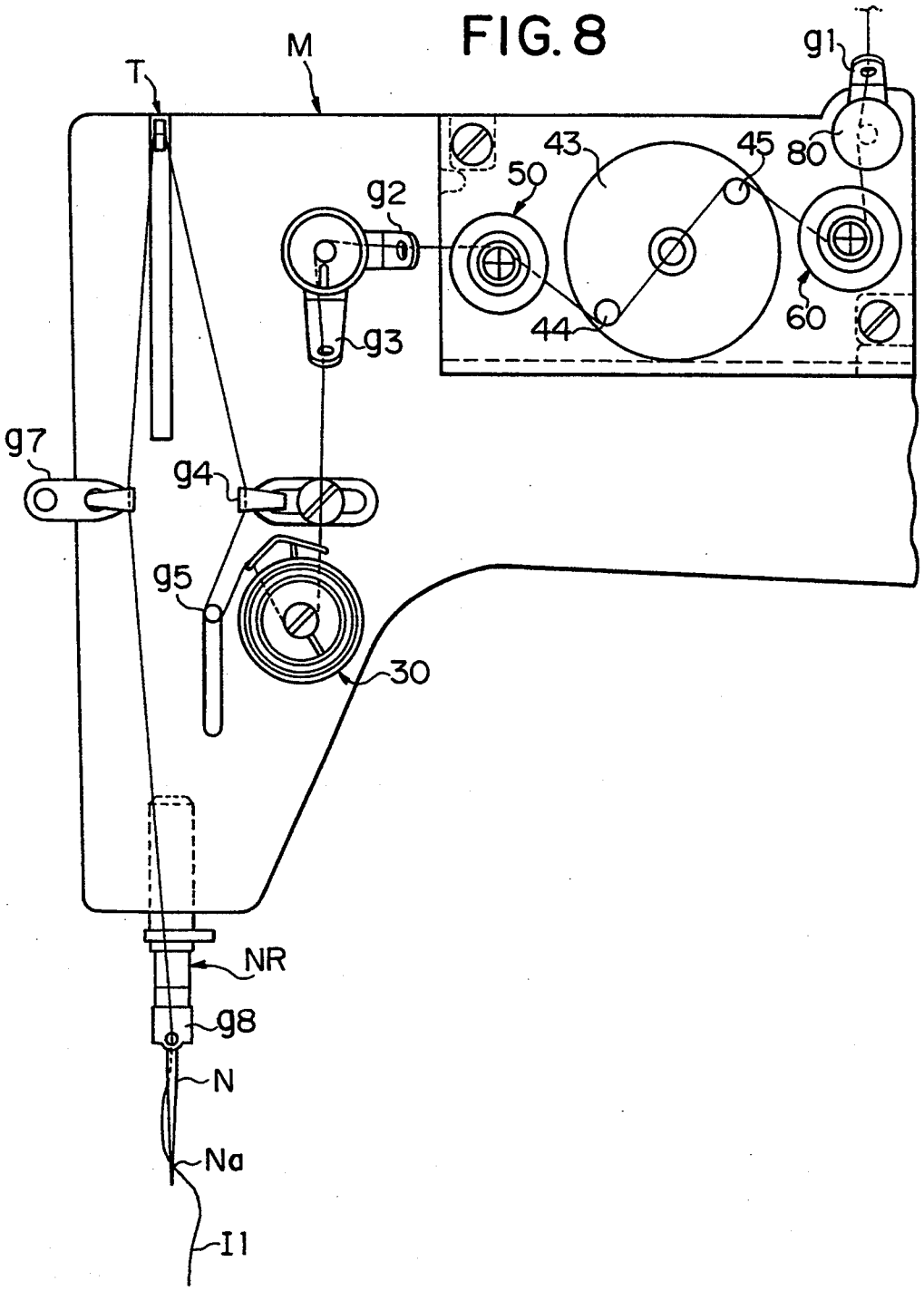
FIG. 8 is a partial front view similar to FIG. 7 but showing the needle thread pulled back from what is shown in FIG. 7.

FIG. 6 is a block diagram showing an arrangement of a control circuit as in the instant embodiment, wherein a well known type of a microcomputer 100 comprises control means such as CPU 101, ROM 102, and RAM 103. Connected to the input side of the CPU 100 are an input unit 109 adapted to input various data and commands thereto, a pulse generator 104 adapted to output a pulse signal synchronously with rotation of a main shaft of the sewing machine acting to vertically move the needle N, and the potentiometer 105. Connected to output side of the CPU 101 are a motor 106 for the sewing machine, and a solenoid 107 for driving the thread trimmer mechanism. The rotary solenoid 42, and solenoids 51, 61 and 108 are controlled by the CPU 101. It is noted that the solenoid 108 is a solenoid that releases the upper thread from engagement with the main thread tension unit 32.

According to the needle thread supply apparatus arranged as above, the needle treat I1 as delivered from the upper thread supply source (not shown) passes over various components such as a thread guide g1, the second sub thread tension unit 80, the second upper thread retainer mechanism 60, the feed passage control mechanism A, the first upper thread retainer means 50, a thread guide g2, the first sub thread tension unit 70, a thread guide g3, the main thread tension unit 30, the check spring 41, upper thread guides g4, g5, the thread takeup lever T and a thread guide g7 and through the eye Na in the needle N to the seam.

During sewing operation, some components such as the solenoid 107, 108, 42, 51, and 61 are deenergized so that the first and second needle thread retainer means enables the upper thread to be in a released condition thus holding the thread delivery pins 44, 45 as well as the rotary plate 43 in the initial position. For this reason, the first and second upper needle retainer means is held rectilinear as shown in FIG. 1. In this instance, the main thread tension unit 30 and the first and second sub thread tension units 70, 80 are allowed to clamp the upper thread I1 by spring force as set by the thread tension springs 75, 85. The upper thread I1 is subjected to a predetermined tension as set by the upper thread clamping force of the main thread tension unit 30 to form stitches with a desired tightness.

Figure 9:
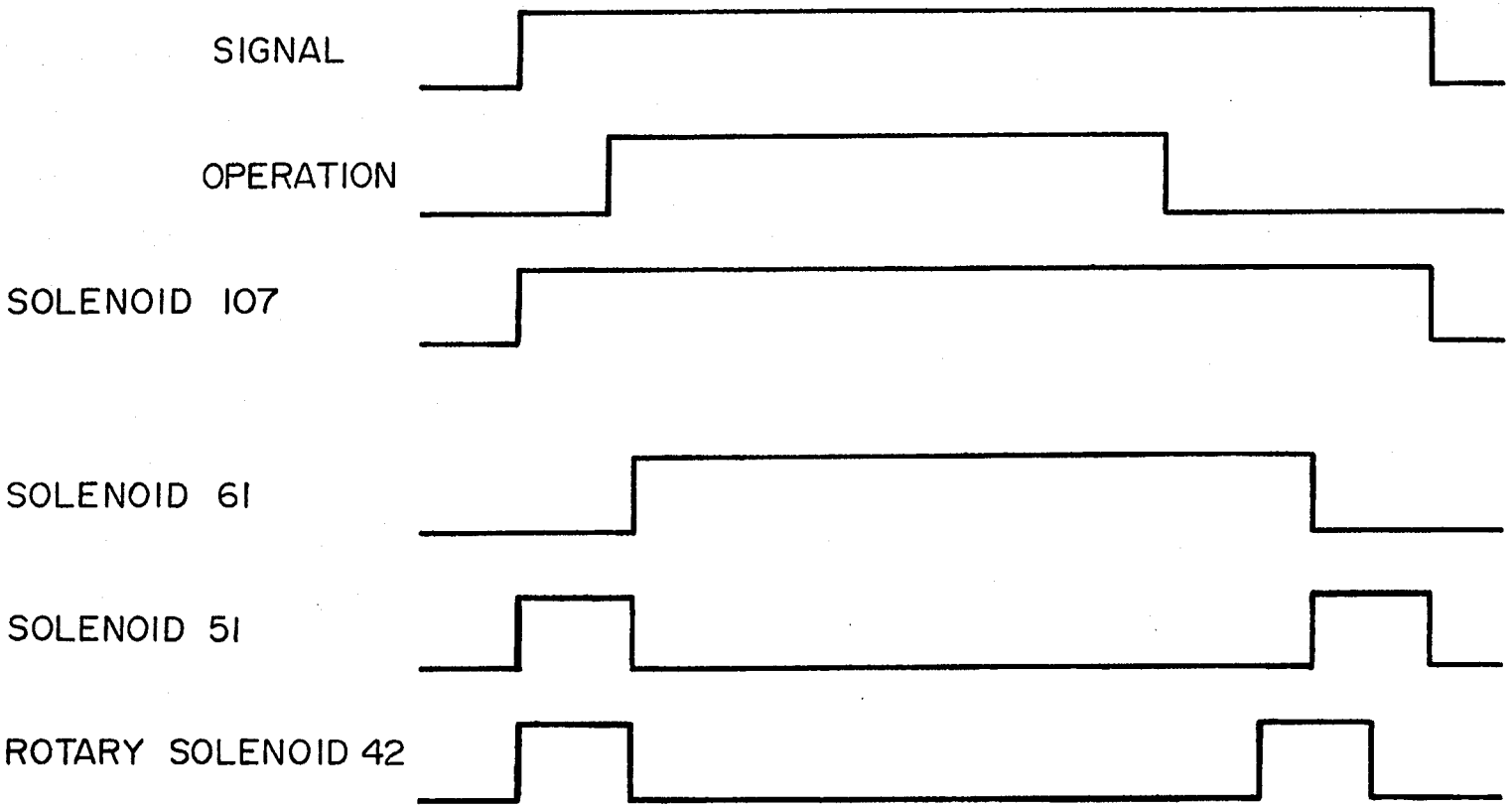
FIG. 9 is a timing chart illustrating operational characteristics of the components of the needle thread feed control apparatus.
Figure 10:
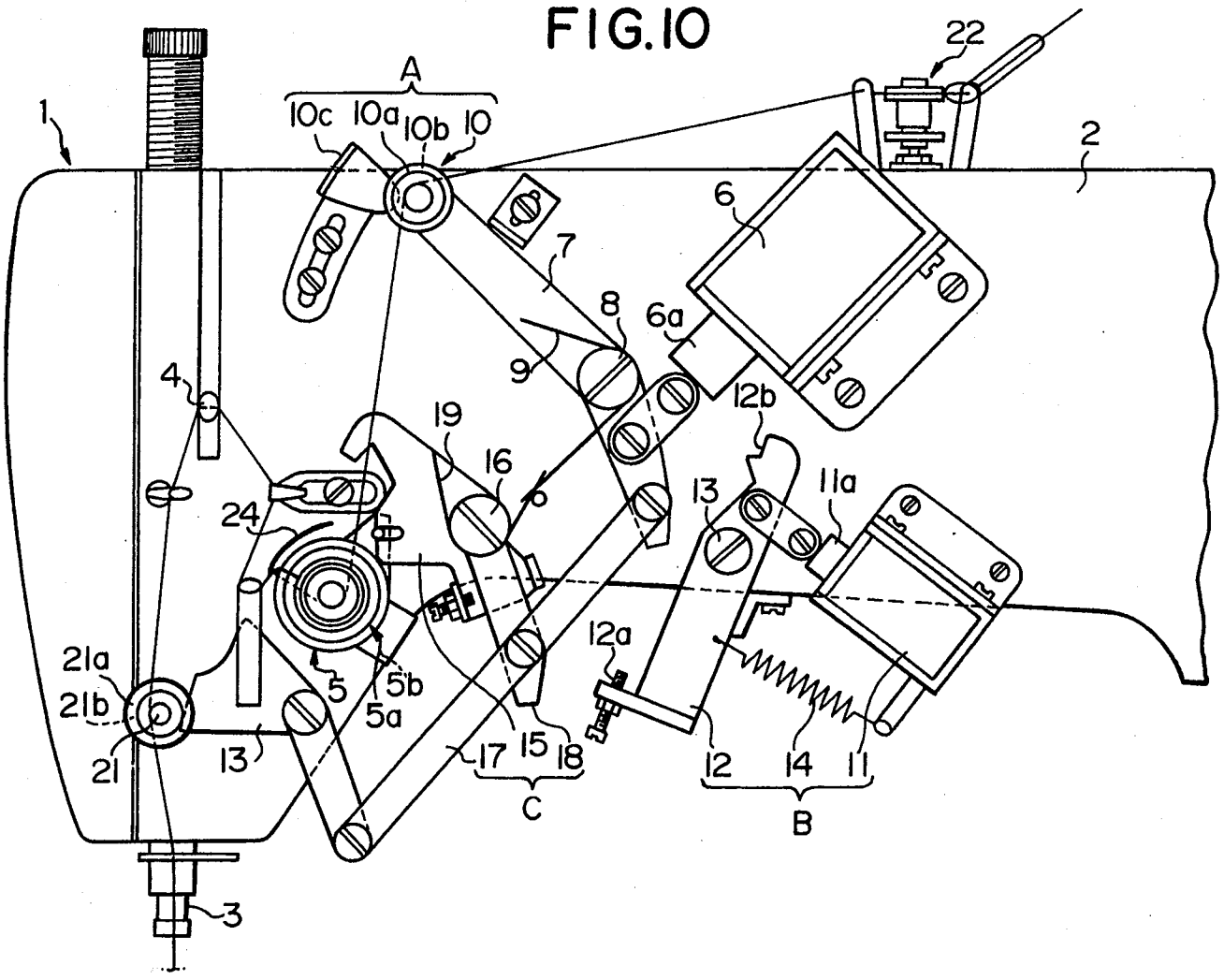
FIG. 10 is a partial front view showing a needle thread supply mechanism according to the prior art.
Figure 11:
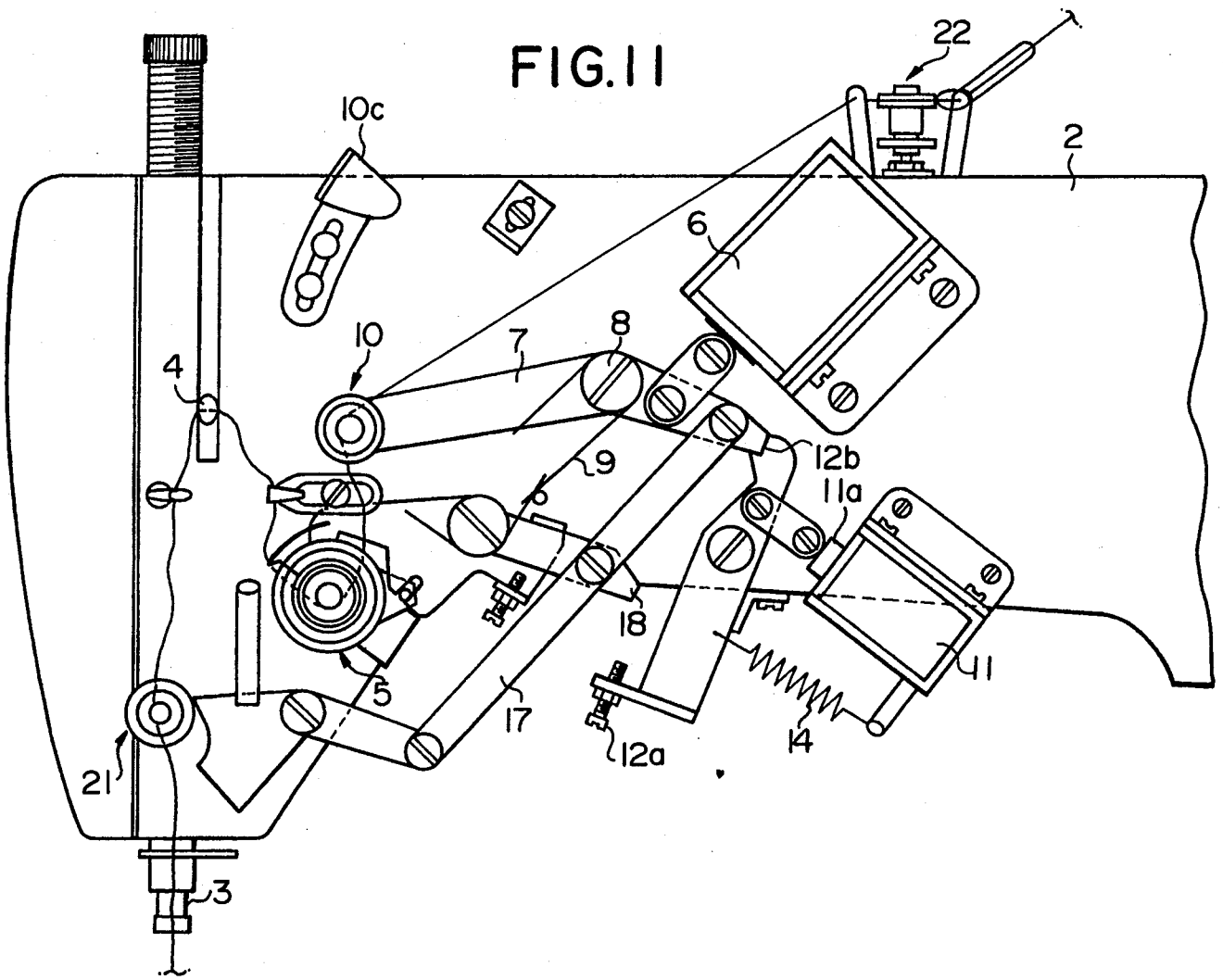
FIG. 11 is a partial front view showing the manner in which the upper thread is extracted from what is shown in FIG. 10.
Figure 12:
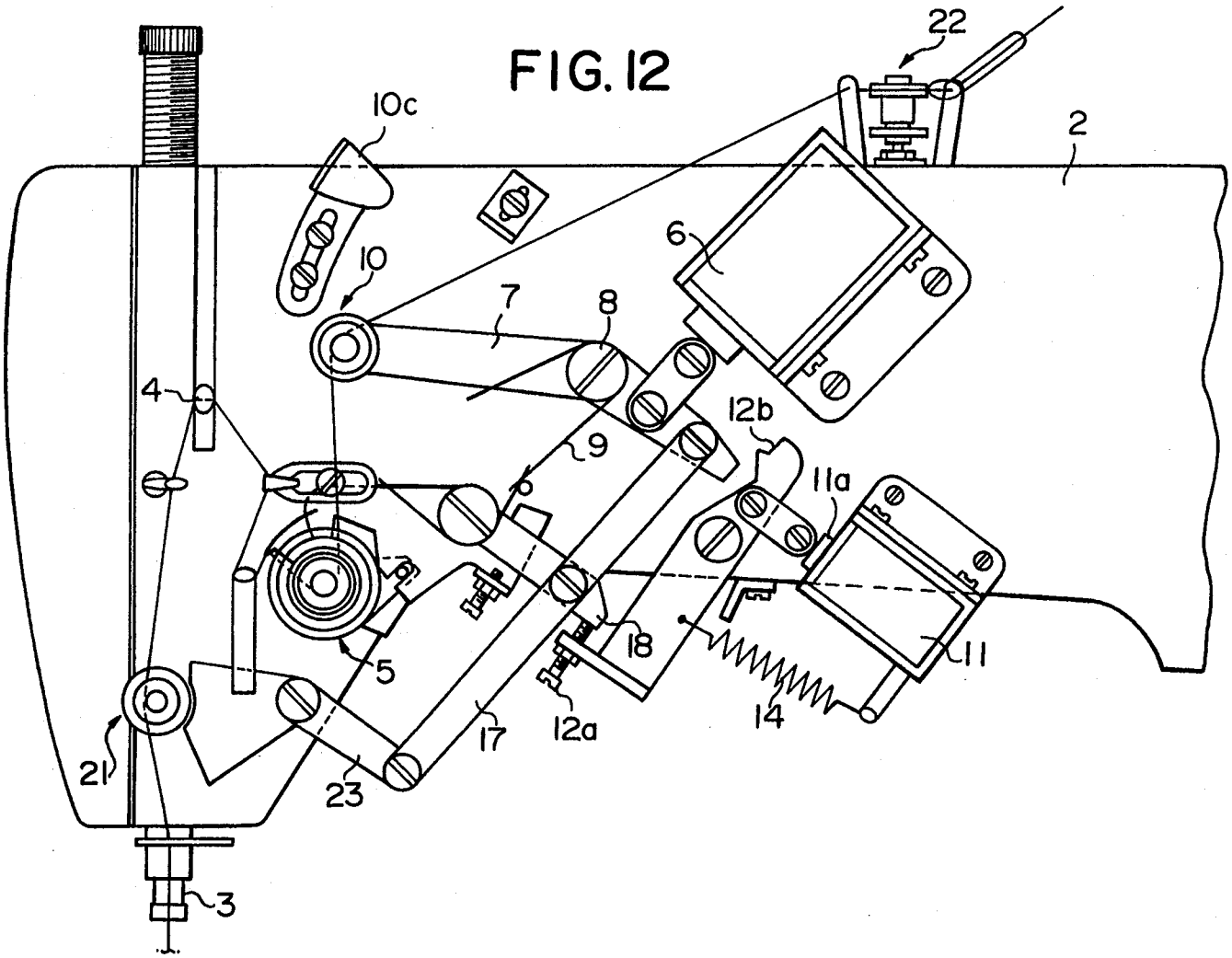
FIG. 12 is a partial front view showing the manner in which the upper thread is pulled back from what is shown in FIG. 10.

Now a predetermined signal for thread trimming is output as illustrated in FIG. 9 after completion of the sewing operation to cause the CPU 101 to actuate solenoid 51 of the first upper thread retainer means prior to trimming performed by the thread trimmer mechanism 90, thereby positively holding the upper thread I1. Under such a condition, the rotary solenoid 42 incorporated in the feed passage control mechanism A is actuated to rotate the rotary plate 43 by a predetermine angle (90° in this instance) as seen from FIG. 7. This converts the thread supply or feed passage from the second upper thread retainer means 60 to the second upper thread retainer means from a linear form to a zig zag form to increase the distance of the passage, thereby delivering the upper thread by increment from the supply source.

When the solenoid 61 is energized as shown in FIG. 9, the second upper thread retainer means 60 is caused to hold the upper thread I1. The solenoid 51 is in turn deenergized to release the upper thread I1 from the first upper thread retainer means 50 to then deenergize the solenoid 42, thereby returning the rotary plate 43 to its initial position. As a result, the upper thread I1 extended from the second needle thread retainer means 60 to the needle N is slackened by the extent of the upper thread previously fed or delivered. The length L1 of the needle thread I1 which has been delivered by the previous feed operation would be L−La:

Wherein L is the length of the upper thread which is forcibly drawn out downwardly from the needle plate NB by the thread spreading blade 91 through the trimming operation by the thread trimmer mechanism 90; and, La is the length of thread which is obtained by adding the increment of the upper thread derived from movement of the check spring 30*a* to the elongation amount of the thread when thread trimming.

In this manner, the thread feed operation is performed, the CPU 101 actuates the solenoid 108 to release the upper thread from its clamp engagement with the main thread tension unit 30 for operating the solenoid 107 to have the thread trimmer mechanism 90 cut or trim the threads. At this moment, the thread spreading blade 91 acts to downwardly draw out the upper thread I1 which has been slacked by the previous feed operation. Subsequently, the upper thread I1 is subjected to its elongation as previously estimated but not excessively elongated to prevent it from being trimmed or cut in an inappropriate position. On the other hand, the second upper thread retainer means is caused to firmly clamp the needle thread so that the latter is not drawn out from the side of the upper thread supply source by the thread draw-out operation. Thus, the remaining thread left on the needle after thread trimming is stabilized. The upper thread I1 drawn out by the thread spreading blade 91 is subjected to a predetermine tension (0—some g.) by the first sub thread tension mechanism 70 to thus obtain a sharp cutting and well trimming function.

Upon thread trimming, the CPU 101 actuates the rotary solenoid 42 of the feed passage control mechanism 40 in a predetermined timing until the next sewing operation is initiated, thereby rotating the rotary plate 43 by 90°. During this rotation, the potentiometer normally detects the rotational position of rotary plate 43 for input to CPU 101. Then, the potentiometer decides when the rotary plate 43 reaches a predetermined angle (less than 90°) as preset to allow the CPU 101 to hold the upper thread 11 by the first upper thread retainer means 50 as shown in FIG. 9 and to release the upper thread from its engagement with the second upper thread retainer means 60. This will draw back the upper thread I1 from the needle side to an extent corresponding to the rotational angle of the rotary plate 43.

It is noted that the length L2 of the upper thread I1 as drawn back is what is preset by the input unit. Normally, what is set thereby is somewhat shorter than the length L1 of the upper thread I1 delivered by upper thread draw-out operation but provides the minimum length of the thread which does not depart from the work fabric at the first stitch when the next sewing operation is initiated. In view thereof, according to the instant apparatus, a seam may be positively formed at the next first stitch.

The CPU 101 also serves to deenergize the solenoid 61 of the second upper thread retainer mechanism 60 for releasing the upper thread in preparation for the next sewing operation when the rotary plate 43 reaches a position where it is rotated at its maximum to complete the upper thread draw-out operation.

Various modifications and changes may be made to the needle thread feed control apparatus without departing from the scope of the claims. For instance, the rotary plate 43 may be rotated by a stepping motor or a servo motor to adjust the amount of the upper thread delivered instead of control being made by the first and second needle thread retainer means for clamping or releasing the needle. Alternately, rotation of the rotary plate 43 may be limited not only to simplify control on the first and second upper thread retainer means but also to eliminate the use of the potentiometer 105. The aforementioned delivery and draw-out may be made by a pair of rollers which are positively and reversely rotated by the stepping motor or the like. Further, other feed passage control mechanisms may be employed as long as the upper thread I1 runs in a zig zag form. For example, elevating means or vertically movable means like the thread takeup lever T disposed between the first and second needle thread retainer means 50 and 60.

We claim:

1. In a sewing machine which comprises thread cutting means for cutting a thread beneath a needle plate in response to a thread cutting signal generated by a control circuit, a first holder means positioned along a thread path leading from a predetermined thread supply source to a needle to hold or release said thread and a second holder means positioned along said thread path on a side of said needle away from said first holder means to hold or release said thread; wherein the improvement comprises a thread control apparatus comprising:

thread drawing means located between said first and second holder means, having a first operative condition to draw out a predetermined amount of said thread on said thread supply source side through said first holder means and a second operative condition to draw out a predetermined amount of said thread on said needle side through said second holder means; and control means operative to cause said second holder means to hold said thread and said first holder means to release said thread prior to starting thread cutting operation by said thread cutting means, then causing said thread drawing means to enter said first operative condition, further causing said second holder means to release said thread and said first holder means to hold said thread from when said thread cutting operation is completed until a next sewing operation is commenced, further setting said thread drawing means into said second operative condition.

2. In a sewing machine which comprises thread cutting member for cutting a thread beneath a needle plate in response to a thread cutting signal generated by a control circuit, a first holder means positioned along a thread path leading from a predetermined thread supply source to a needle to hold or release said thread and a second holder means positioned along said thread path on a side of said needle away from said first holder means to hold or release said thread; wherein the improvement comprises a thread control apparatus comprising:

a thread drawing member located in engagement with said thread along said thread path between said first and second holders, functioning to draw out said thread on said thread supply source side by said first holder or on said needle side by said second holder;

an operative member coupled to said thread drawing member having a first operative condition in which said thread on said thread supply source side is drawn out in a predetermined amount and a second operative condition in which said thread on said needle side is drawn out in a predetermined amount; and a control circuit causing said second holder to hold said thread and said first holder to release said thread prior to start of a thread cutting operation by said thread cutting member, then causing said operative member to execute said first operative condition, further causing said second holder to release said thread and said first holder to hold said thread from when said thread cutting operation is completed until a next sewing operation is commenced, then setting said operative member into said second operative condition.

3. An apparatus set forth in either of claims 1 or 2 characterized in that said thread in said first operative condition is drawn out in an amount more than that in which said thread in said second operative condition is drawn out.

4. In a sewing machine which comprises thread cutting member for cutting a thread beneath a needle plate in response to a thread cutting signal generated by a control circuit, a first holder means positioned along a thread path leading from a predetermined thread supply source to a needle to hold or release said thread and a second holder means positioned along said thread path on a side of said needle away from said first holder means to hold or release said thread; wherein the improvement comprises a thread control apparatus comprising:

a thread drawing member located in engagement with said thread along said thread path between said first and second holders, functioning to draw out said thread in a predetermined amount on said thread supply source side by said first holder or on said needle side by said second holder;

an operative member enabling said thread drawing member to draw out said thread on said thread supply source side or on said needle side; and a control circuit for controlling said operative member causing said second holder means to hold said thread and said first holder means to release said thread prior to start of a thread cutting operation by said thread cutting member and said thread on said thread supply source side to be drawn out in a predetermined amount by said thread drawing member, further causing said second holder means to release said thread and said first holder means to hold said thread from when said thread cutting operation is completed until a next sewing operation is commenced and said thread on said needle side to be drawn out by said thread drawing member.

5. An apparatus set forth in either of claims 1 or 2 characterized in that said thread on said thread supply source side is drawn out in an amount more than said thread on said needle side is drawn out.

* * * * *